United States Patent [19]

Tobler

[11] 4,174,740

[45] Nov. 20, 1979

[54] METHOD AND APPARATUS FOR SUPPLYING INGREDIENTS TO A CONCRETE MIXER

[76] Inventor: Hugh J. Tobler, 103 N. Kenwood, Indianola, Iowa 50125

[21] Appl. No.: 935,534

[22] Filed: Aug. 21, 1978

[51] Int. Cl.[2] ..... B65B 1/04

[52] U.S. Cl. ..... 141/1; 141/67; 141/231; 222/195; 222/254; 414/505

[58] Field of Search ..... 141/1, 9, 67, 100, 231, 141/284, 387; 214/519-522; 280/24 R; 302/50; 222/195, 254, 413

[56] References Cited

U.S. PATENT DOCUMENTS

| | | | |
|---|---|---|---|
| 3,171,558 | 3/1965 | Sharp | 214/522 |
| 3,452,864 | 7/1969 | Eckhardt | 302/50 X |
| 3,466,018 | 9/1969 | Nourse | 214/519 X |

*Primary Examiner*—Richard E. Aegerter
*Assistant Examiner*—Frederick R. Schmidt
*Attorney, Agent, or Firm*—Zarley, McKee, Thomte, Voorhees & Sease

[57] ABSTRACT

The apparatus of the present invention comprises a vehicle having a cement carrying container and two water carrying containers. The cement container is V-shaped in cross section with outwardly, flared walls adjacent the apex of the V, and includes an auger screw conveyor inside the container extending along the V-shaped bottom thereof. The auger is adapted to convey the cement within the container along the length of the auger to an outlet opening adjacent the bottom of the container. A vertical conveyor carries the cement upwardly from the outlet opening to a third conveyor which carries the cement to the concrete mixer being serviced. Within the container below the auger conveyor are a plurality of fluffing means which introduce air under pressure to the cement to cause it to be fluffed and to prevent it from packing around the auger screw. The two water containers are positioned on opposite sides of the cement container so as to provide symmetrical loading of the weight of the water about the longitudinal axis of the vehicle.

10 Claims, 9 Drawing Figures

METHOD AND APPARATUS FOR SUPPLYING INGREDIENTS TO A CONCRETE MIXER

BACKGROUND OF THE INVENTION

This invention relates to a method and apparatus for supplying ingredients to a concrete mixer.

The supplying of concrete at various construction sites is often a problem. The conventional manner for doing this is to provide a plurality of ready mix concrete trucks which have the concrete mixed and which continue to tumble the concrete from the point of mixing to the construction site.

Several problems occur with the ready mix method of conveying concrete to the construction site. One of the most serious problems is a result of the fact that the concrete begins to set up the minute that water is added to it. Thus, if the truck conveying the ready mixed concrete does not empty its contents within a relatively short time, the concrete will set up and harden within the truck. Often times if the construction crew is not ready for the concrete within the truck when it arrives at the site, it is necessary for the driver of the truck to empty the contents rather than to permit them to set up within the truck.

As a result of the tendency of concrete to set up, timing becomes critical with respect to the delivery of the concrete to the construction site. The trucks must be timed to arrive at various time intervals rather than to arrive all at once. The trucks cannot stand and wait for the construction crew to ready the site for the pouring of concrete. The site must be ready at the time the concrete arrives.

The ready mix method of delivering concrete also requires numerous trucks and drivers which increases the cost as a result of the extensive labor and capital which must be invested in the plurality of trucks and drivers.

As an alternative to conveying the ready mixed concrete to the construction site, attempts have been made to mix the concrete at the construction site. This process has the advantage that the ingredients may be carried to the construction site and stored until the concrete is mixed. The water is added only after the concrete is mixed.

However, the mixing of concrete at the construction site also presents certain problems. Cement is a very difficult commodity to handle, particularly with respect to the transporting and conveying of the cement to the cement mixer. The reasons for the difficulty in handling cement arise from its inherent fine powdery consistency and also from its tendency to set up when exposed to moisture or water. When a container of cement is conveyed by a vehicle, the vibration of the vehicle during transit causes the cement to pack down into a very hard consistency. This packing down causes binding of conveyor screws for conveying the cement out of the container into the cement mixer. Often times the conveyor screws are locked as a result of the packing of the cement around them during transit.

Furthermore, the container for carrying the cement must be sealed against moisture and water so that the cement is not exposed to moisture or water with the resulting hardening of the cement.

It is also important that the cement be stored in a container which can be completely emptied in order to make full use of all the cement. The storing of cement in bags on the ground is disadvantageous inasmuch as it results in exposing the cement to moisture which causes setting up of the cement.

SUMMARY OF THE INVENTION

The present invention comprises a truck having a cement container thereon and also having two water containers thereon. The cement container is V-shaped in cross section with a small flared out portion adjacent the apex of the V, and includes a conveyor screw extending along the V-shaped bottom thereof. A vertical conveyor screw is in communication with an outlet opening for receiving the cement from the first mentioned conveyor screw and for carrying it upwardly to a third conveyor screw which in turn carries the cement to the concrete mixer.

A plurality of fluffing means are provided below the conveyor screw that is within the cement container. The fluffing means are adapted to introduce pressurized air into the cement so as to cause it to fluff and to prevent it from packing around the conveyor screw. This results in the prevention of binding of the cement about the conveyor screw as a result of vibration during the transporting of the cement by the vehicle.

The cement container and the various screw augers connected thereto are sealed to minimize the exposure of the cement to moisture.

Individual power means are provided for controlling the auger screws individually so as to permit them to be cleaned out after the desired amount of cement is conveyed to the concrete mixer.

Therefore, a primary object of the present invention is the provision of an improved method and apparatus for supplying ingredients to a concrete mixer.

A further object of the present invention is the provision of means for preventing packing of cement within the container during the transporting thereof.

A further object of the present invention is the provision of apparatus for carrying cement which effectively seals the moisture out so as to prevent mixing of moisture with the cement during transporting and conveying of the cement to the concrete mixer.

A further object of the present invention is the provision of an apparatus which permits not only the carrying of cement, but also the carrying of water to the construction site for use in mixing concrete.

A further object of the present invention is the provision of apparatus having separate controls for conveying the cement and for conveying the water to the concrete mixer.

A further object of the present invention is the provision of apparatus having conveyors which cause the cement to flow freely from the cement container to the concrete mixer.

A further object of the present invention is the provision of apparatus which distributes the weight of the cement on the vehicle in a symmetric fashion.

A further object of the present invention is the provision of a device which is durable, economical to manufacture, and efficient in operation.

DETAILED DESCRIPTION OF THE DRAWINGS

Figures 1, 2, 3, 4, 5, 6, 7, 8, 9:
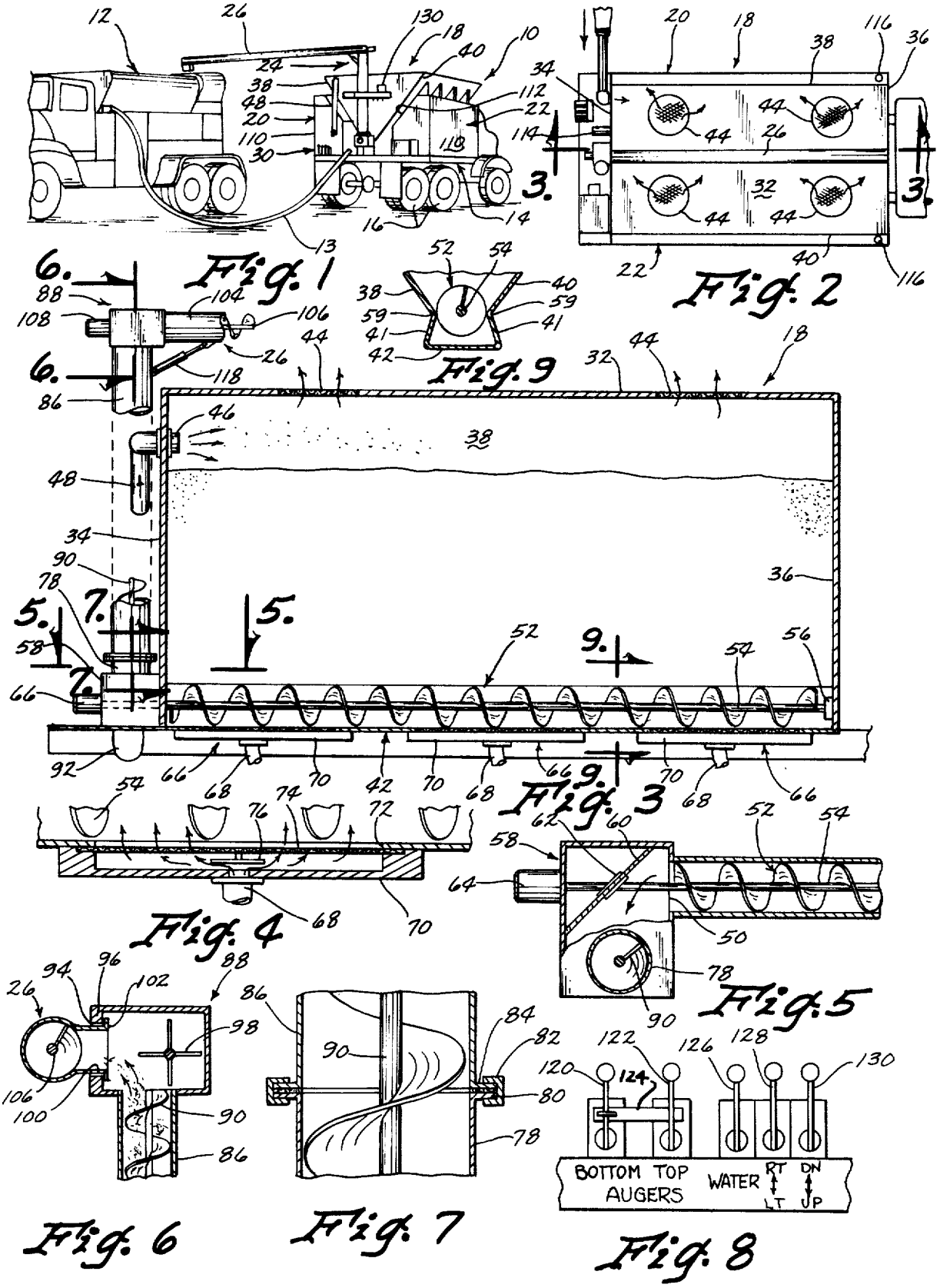
FIG. 1 is a perspective view showing the apparatus of the present invention supplying ingredients to a concrete mixer.
FIG. 2 is a top plan view of the apparatus of the present invention.
FIG. 3 is a sectional view taken along line 3—3 of FIG. 2.
FIG. 4 is a partial sectional view showing the fluffing means of the present invention.
FIG. 5 is a sectional view taken along line 5—5 of FIG. 3.
FIG. 6 is a sectional view taken along line 6—6 of FIG. 3.
FIG. 7 is a sectional view taken along line 7—7 of FIG. 3.
FIG. 8 is a partial rear elevational view showing the controls for the present apparatus.
FIG. 9 is a sectional view taken along line 9—9 of FIG. 3.

Referring to FIG. 1, the numeral 10 generally designates the supply vehicle utilizing the present invention. Vehicle 10 is shown loading water and cement into a concrete mixing unit designated by the numeral 12.

Vehicle 10 includes a bed frame 14 which is supported by a plurality of wheel assemblies 16. Mounted on bed frame 14 is a cement container 18 and two water containers 20, 22. Connected to the lower end of container 18 is a vertical external conveyor 24, and connected to the upper end of conveyor 24 is an external horizontal boom like conveyor 26. A water hose 13 extends from vehicle 10 to mixing unit 12. A plurality of controls 30 are provided at the rear of vehicle 10 for controlling the various power mechanisms therein as will be described hereinafter.

Cement container 18 includes a top wall 32 opposite end walls 34, 36, a pair of side walls 38, 40, and a bottom wall 42. Top wall 32 is provided with a plurality of vent openings 44 which are covered by a canvas or other fabric material which permits air to exit therefrom, but which prevents the entry of moisture and prevents the exit of cement dust from the container 18.

Side walls 38, 40 converge toward one another as they progress downwardly from top wall 32 so as to create a V-shaped configuration for container 10. However, just prior to reaching the apex of the V, side walls 38, 40 flare outwardly at 41 before they join with bottom wall 42 at the lower end of container 18. This flared out portion 41 is important to prevent packing of cement around the conveyor auger.

An inlet passageway 46 is provided in end wall 34 and is connected to a pneumatic conduit 48. Conduit 48 may be connected to means for introducing cement into container 18 pneumatically in conventional fashion. Vent openings 44 permit air to escape from container 18 in response to the pneumatic pressure created by introducing cement to the interior of container 18 pneumatically.

Adjacent the bottom of end wall 34 is an outlet opening 50 (FIG. 5) which permits the exit of cement from container 18. Extending along bottom wall 42 in alignment with opening 50 is an interior auger conveyor 52 having an auger shaft 54. Shaft 54 is rotatably mounted in a bearing 56 in end wall 36 and extends outwardly through opening 50 into a lower junction box 58. Box 58 has therein a diagonal baffle plate 60 having a bearing 62 therein which rotatably receives shaft 54. Shaft 54 is then connected to and driven by a hydraulic motor 64 mounted outside junction box 58. As can be seen in FIG. 9, the outer circumference of auger 52 is in close proximity to the elbow 59 between flared out portions 41 and V-shaped walls 38, 40.

When cement is originally placed within container 18 pneumatically, it is in a fluffed state and is easily conveyed outwardly through outlet opening by rotation of auger 52. However, when vehicle 10 is driven long distances the vibration caused by such transportation results in the packing down of the fluffed cement within container 18. This packing results in binding around auger 52 and can actually lock the auger against movement.

To prevent this packing the present invention utilizes flared out portions 41 together with a plurality of fluffing means 66 mounted below auger 52. Fluffing means 66 comprise a nozzle 68 adapted to be connected to a source of air pressure. Nozzle 68 is mounted to a housing 70 which is mounted to the under surface of bottom wall 42, and which encloses a window 72 (FIG. 4) provided in bottom wall 42. Window 72 is covered by a screen 74 which has attached thereto a deflecting plate 76 which is presented directly opposite the opening of nozzle 68. In operation, air pressure is introduced to nozzle 68 and deflects outwardly as a result of its engagement with deflector plate 76. The air then forces its way upwardly through screen 72 and through the cement which is directly thereabove. The result is the fluffing of the cement from the bottom of the container upwardly so that the cement does not pack tightly around auger 52. As can be seen in FIG. 3, a plurality of fluffing means 66 are provided along the length of auger 52 so as to cause fluffing along the entire length thereof.

Junction box 58 has a circular neck 78 extending upwardly therefrom. As can be seen in FIG. 5, neck 78 is offset from outlet opening 50. The upper end of neck 78 is provide with a lip flange 80 which is received within a coupling ring 82 having a U-shaped cross section for slidably receiving lip flange 80. Also slidably enbraced within the U-shaped cross section of coupling 82 is a lip flange 84 on the lower end of a vertical auger housing 86, the upper end of which is connected to an upper junction box 88.

Rotatably mounted within auger housing 86 is a vertical auger 90 which is connected at its lower end to a hydraulic motor 92. The tolerances between the outer flighting edges of auger 90 and the inner surface of housing 86 must be very close in order to prevent the powdered cement from falling downwardly as it is conveyed. If the tolerances are too broad, the powder will not be conveyed by the auger efficiently, but will tend to fall downwardly and slip off the flightings.

Upper junction box 88 includes an outlet opening 94 which is defined by an annular lip flange 96. Within box 88 is a flipper paddle 98 which is rotatably mounted about a horizontal axis and which serves to flip the cement to the left as viewed in FIG. 6 as the cement is introduced upwardly into junction box 88 from auger 90.

Rotatably received within opening 94 formed by annular lip flange 96 is an annular neck 100 having lip flanges 102 which engage lip flange 96 and prevent neck 100 from separating out of opening 94. Neck 100 is connected to boom like conveyor 26 which has a conveyor housing 104 and an auger 106 within housing 104. A hydraulic motor 108 drives auger 106.

Each water container 20, 22 includes a vertical side wall 110, which corresponds generally to the outer lateral edges of bed frame 14. Each container also includes an inner sloping wall 112 which extends parallel to one of the sloping side walls 38, 40. Containers 20, 22 are arranged in symmetrical relationship with respect to the longitudinal center line of supply vehicle 10 so that the weight of the water in containers 22 is symmetrically arranged on bed frame 14. Containers 20, 22 are connected to an outlet coupling 114 which may be connected to hose 12. Also each container 20, 22 has in its upper wall a capped inlet opening 116 for permitting the filling of containers 20, 22. A pump (not shown) is provided for pumping the water out of containers 20, 22 through hose 13 to the cement mixing unit 12.

Coupling 82 permits vertical auger housing 86 to be rotated about a vertical axis, and this results in the swinging movement of boom like conveyor 26 about the same axis. The elevation of boom 26 may also be adjusted by a hydraulic cylinder 118 which is connected at one end to vertical auger housing 86 and at the other end to housing 104 of boom 26. Extension and retraction of cylinder 118 causes rotation of boom 26 about the pivotal connection provided between lip flanges 102, 96 (FIG. 6).

Referring to FIG. 8, various individual hydraulic controls are provided. Auger 52 is controlled by lever 120 and augers 90, 106 are controlled by lever 122. An interlock bar 124 is fixed to lever 120 and engages lever 122 whenever lever 120 is pulled rearwardly. This causes all the augers to be actuated whenever auger 52 is actuated. However, when lever 120 is pushed forward to shut off auger 52, lever 122 continues the operation of augers 90, 106 so as to permit them to empty.

Lever 126 controls the pump for pumping the water. Lever 128 is connected to a hydraulic motor 130 (FIG. 1) which is connected to a chain drive mechanism (not shown) for causing rotation of vertical housing 86 about the rotational coupling provided by coupling 82. Lever 122 controls hydraulic cylinder 118 for raising and lowering boom 26 about the horizontal axis provided by the pivotal connection between boom 26 and upper junction box 88.

The present invention thus provides an improved means for conveying the ingredients for concrete mixing to the construction site. Only one or two vehicles is required in contrast to the numerous vehicles required for supplying ready mix concrete. Furthermore, it is possible for a vehicle to arrive at the construction site well in advance of the time when the concrete is actually poured, inasmuch as the ingredients may be stored indefinitely within the supply truck. The fluffing means of the present invention prevents the packing of the cement in the cement container so as to facilitate the conveying of the cement out of the container into the concrete mixer. The cement container and the various auger housings are sealed to prevent moisture from entering the container or auger housings, thereby protecting the cement from moisture which could cause the cement to set up. The cement flows freely through the auger conveyors due to the fluffing action provided by the fluffing means at the lower end of the container. The water is also carried by the present device and therefore facilitates the mixing of concrete at the construction site. Independent controls are provided for the various components of the conveyors so as to give a maximum flexibility in the operation of the supply vehicle. Thus, it can be seen that the device accomplishes at least all of its stated objectives.

What is claimed is:

1. A mobile device for supplying ingredients to a concrete mixer, said device comprising:

a vehicle having wheels rotatably mounted to a vehicle frame and supporting said vehicle frame for rolling movement;

a cement container mounted on said vehicle frame, said cement container having a top wall, a pair of opposite side walls, a bottom wall and a pair of opposite end walls, said side walls converging toward one another as they extend downwardly from said top wall to said bottom wall;

one of said end walls having an outlet opening adjacent the lower end thereof adjacent said bottom wall;

a first auger conveyor mounted within said container adjacent said bottom wall and extending along the length of said bottom wall, one end of said first conveyor being adjacent said outlet opening, said conveyor being rotatable to carrying cement out through said outlet opening;

cement fluffing means positioned below said first auger conveyor, said fluffing means being connected to a source of compressed air and being capable of introducing said compressed air into said container from below said first auger conveyor whereby said first compressed air fluffs the cement around said first conveyor and inhibits packing of said cement during movement of said vehicle;

external conveyor means located outside said cement container and connected to said outlet opening of said cement container for carrying cement from said container to a concrete mixer;

said container having an inlet opening therein for permitting the introduction of cement into said container, said container sidewalls first converging towards one another adjacent their lower ends and then flaring outwardly away from one another at the lowermost portions of their lower ends, wherein said first auger conveyor is positioned adjacent the point where said sidewalls begin flaring outwardly.

2. A device according to claim 1 wherein at least one water container is mounted on said vehicle frame.

3. A device according to claim 2 wherein said cement container is approximately V-shaped in cross section, said bottom wall thereof extending along the approximate longitudinal centerline of said vehicle, said water container being positioned below one of said V-shaped side walls and having a slanted wall which faces and extends parallel to said one V-shaped wall, a second water container being mounted on said vehicle frame on the opposite side of said cement container from said first mentioned water container, said second water container having a slanted wall which faces and extends parallel to the other of said V-shaped walls of said cement container; the shape and position of said two water containers on said vehicle frame being symmetrical with respect to the longitudinal center line of said vehicle.

4. A device according to claim 1 wherein said external conveyor means comprises a vertical conveyor and a third conveyor, first junction means operatively connecting the lower end of said vertical conveyor to said first auger conveyor adjacent said outlet opening of said cement container; second junction means operatively connecting said upper end of said vertical conveyor to said third conveyor.

5. A device according to claim 4 wherein said cement container, said first junction means, said vertical conveyor, said second junction means and said third conveyor are sealed to minimize the entry of moisture into their interiors.

6. A device according to claim 5 wherein said vertical conveyor is connected to said first junction means by first coupling means permitting rotation of said vertical conveyor about a vertical axis, first power means connected to said vertical conveyor for causing rotation about said vertical axis, second coupling means pivotally connecting said third conveyor to said second junction means for pivotal movement about a horizontal axis, second power means interconnecting said second junction means and said third conveyor to cause pivotal movement of said third conveyor about said horizontal axis.

7. A device according to claim 1 wherein said fluffing means comprises a plurality of openings in said bottom wall at points positioned in spaced relation along the length of said bottom wall, screens being positioned over said openings, air nozzle means positioned directly below said screens and oriented to direct a stream of air upwardly through said screen into said cement container, air conduit means connected to said nozzle means and to a source of pressurized air.

8. A device according to claim 7 wherein each screen has an air deflector attached thereto and positioned to receive and deflect the air stream exiting from said nozzle means.

9. A device according to claim 1 wherein said fluffing means is located below said point where said sidewalls begin flaring outwardly.

10. A method for transporting and supplying cement and water to a concrete mixer, said method comprising placing cement in a mobile container mounted on a vehicle, said container having a bottom wall and an outlet opening adjacent said bottom wall; a first auger conveyor being within said container and extending along the length of said bottom wall with one end of said first conveyor being adjacent said outlet opening:

placing water in a water container mounted on said vehicle;

transporting said vehicle to a concrete mixer;

fluffing said cement during transporting to prevent packing of said cement around said first auger conveyor, said fluffing being accomplished by introducing pressurized air into said container from below said first auger conveyor;

conveying said cement by said first auger conveyor outwardly through said outlet opening;

conveying said cement upwardly from said outlet opening by means of a vertical conveyor located externally of said container;

conveying said cement horizontally from the discharge end of said vertical conveyor by means of a third horizontal conveyor having its discharge end positioned adjacent said concrete mixer.

* * * * *